US005810249A

United States Patent [19]

Nilsson

[11] Patent Number: 5,810,249

[45] Date of Patent: Sep. 22, 1998

[54] METHOD AND APPARATUS FOR ARTIFICIAL MAKING OF SNOW

[75] Inventor: Lennart Nilsson, Östersund, Sweden

[73] Assignee: Lenko L. Nilsson, Ostersund, Sweden

[21] Appl. No.: 737,356

[22] PCT Filed: Jun. 7, 1995

[86] PCT No.: PCT/SE95/00667

§ 371 Date: Nov. 8, 1996

§ 102(e) Date: Nov. 8, 1996

[87] PCT Pub. No.: WO96/09505

PCT Pub. Date: Mar. 28, 1996

[30] Foreign Application Priority Data

Sep. 21, 1994 [SE] Sweden ..... 9403168

[51] Int. Cl.[6] ..... F25C 3/04

[52] U.S. Cl. ..... 239/2.2; 239/14.2

[58] Field of Search ..... 239/2.2, 14.2

[56] References Cited

U.S. PATENT DOCUMENTS

| | | | |
|---|---|---|---|
| 4,223,836 | 9/1980 | Eager | 239/2.2 |
| 4,593,854 | 6/1986 | Albertsson | 239/14.2 |
| 4,634,050 | 1/1987 | Shippee | 239/2.2 X |
| 4,682,729 | 7/1987 | Doman et al. | 239/2.2 |
| 5,289,973 | 3/1994 | French | 239/2.2 X |
| 5,322,218 | 6/1994 | Melbourne | 239/2.2 |

*Primary Examiner*—Lesley D. Morris
*Attorney, Agent, or Firm*—Larson & Taylor

[57] ABSTRACT

A method for artificial making of snow by a snow making machine (1) comprising a series of nozzles (8) arranged to provide a tubular flow (2) of bulk water drops which are moved along by an inner flow (3) of feeder air, and a series of atomizing nozzles (10) arranged to provide a flow of super cooled nuclei which are created at or adjacent the outer periphery (9) of the snow making machine (1) by a series of atomizing nozzles (1) which are distributed round the snow making machine and radially outside and preferably downstream the bulk water jet nozzles (8) as seen in the flow direction, whereby there is formed a shell (5) of super cooled nuclei extending circumferentially round the flow (2) of bulk water drops, which successively, and over a relatively long way of movement provides a freezing of the drops of water in the flow (2) of bulk water drops.

10 Claims, 4 Drawing Sheets

METHOD AND APPARATUS FOR ARTIFICIAL MAKING OF SNOW

The present invention generally is concerned with artificial snow making, and the invention more particularly relates to a method and an apparatus for making snow crystals by means of snow making machines more effectively, with a higher capacity and with an improved snow crystal formation than has so far been made.

When making snow by means of snow making machines water is ejected through a large number of fine atomizing nozzles and is carried along by a central flow of air. For making small drops of water freeze strongly into frozen particles, so called "nuclei" are introduced into the flow of water drops, the so called bulk water flow. The making of snow crystals by means of this type of snow making machine therefore mainly follows two successive steps:

- in a first step strongly frozen water nuclei (plural form of nucleus) are created in a separate apparatus, called an atomizer;
- in a second step the nuclei, thereby formed, are mixed with water drops coming from the ordinary water jet nozzles of the snow making machine in a so called "plume" having a turbulent flow of air some distance from the snow making machine.

In all priorly known snow making machines only some of the water drops are being frozen are influenced by the nuclei while the water drops are still suspended in the air, whereas a certain part of the ejected water drops fall to the ground in a non-frozen or only partly frozen condition. When such non-frozen water drops frozen lying on the ground they generally form a undesired layer of ice or an egg shell like layer of ice which, when subjected to a load, crack thereby giving off water.

For obtaining an ideal snow mixture in a snow making machine it would be necessary to provide a nuclei activation of any and all water drops in the system, thereby transforming any liquid to ice crystals while the water drops are still suspended in the air. To this end it is primarily necessary:

- to provide an excess production of nuclei;
- that the nuclei grow to a sufficient size as to survive beyond the place of mixing the nuclei with the water drops in the so called "plume";
- that the mixing of nuclei and the water drops takes place after the water drops have been super-cooled.

The creation of nuclei follows certain technical laws: extremely small water drops are formed spontaneously when the absolute humidity is four times higher than the saturation humidity for a given temperature. Such extremely small water drops freeze spontaneously and create small ice-aggregates if the temperature can be reduced to −42° C. or still less temperature. The said small ice-aggregates grow to sufficiently large nuclei by the so called "Bergeron-process", which shortly means that the ice-aggregates will grow at the expense of the water drops if the ice-aggregates co-exist with the water drops in liquid form in a super humidity saturated environment.

In priorly known snow making machines the strongly cooled nuclei used to be injected more of less directly into the flow or air including the water drops, in some cases from inside the curtain of ejected water drops. This has an effect both that the water drops which are located close to the outer periphery of the flow of water drops are being confronted with the relatively warm ambient air, and also that the cooling energy of the nuclei is relatively quickly consumed, whereby a part of said energy gets lost in that the water drops do not get a sufficiently long time to freeze to form ice crystals.

An important feature of the present invention is that the nuclei, which act as catalysts in the freezing process, are created such as to form a shell, or a containment layer, of nuclei surrounding the core of water drops which are conveyed by a flow of air which is first laminary and which, at a distance beyond the water nozzles, is broken up and becomes turbulent. The nuclei are created at a place where the flow of air has the lowest speed thereby forming a containment layer which is moved along without being broken up to any substantial degree and as far as to a place where the air flow changes from laminary to turbulent air flow. The water drops enclosed by the shell of nuclei thereby get a substantially prolonged time for freezing to ice crystals. By forming the snow making machine with a nose cone of a suitable streamline type there is formed a "back zone" or a "static eddy", having practically still standing air at the tip of the nose cone, into which zone extremely finely atomized water drops are ejected at a specific pressure, and whereby said extremely finely atomized particles spontaneously freeze to extremely small ice crystals having a very low temperature, generally a temperature of −42° C. Such super frozen ice crystals provide the nuclei of the system. Thanks to the specific shape of the nose cone the ambient air is sucked past the nose cone thereby bringing the nuclei, thus formed, into the flow of air.

The numerical relationship between the concentration of ice aggregates and the concentration of water drops can be controlled, and according to the invention this is made in that the environment in which said phases cooperate can be isolated for a certain period of time, and hence all water drops, or at least the major part thereof, can be brought to be consumed by the growing water-nuclei.

It has also shown that a special effect can be obtained if the pressure of the nozzles forming the nuclei is brought to pulsate so that the atomized drops of water are formed in successive pulses.

It is also important to create a changed environment, namely an environment having a super saturated humidity, and to isolate said environment from the ambient atmosphere. This made in two stages:

- in a first stage the "ordinary" atomizing nozzles pulsate out the water by a random fluctuation by a co-operation between compressed air and water inside the collection tube of the atomizer. At each pulse the nozzles create a) the required drops of water for the growth of nuclei and b) small ice aggregates. It should be observed that it is possible to optimize the above mentioned numerical concentration relationship by an adjustment of the relationship between air and water in the collection tube
- a closed containment layer, or a shell, is formed outside the laminar flow of the plume. The laminar adjusted shape (see FIGS. 1 and 2) provides layers of the secondary air which is introduced by the viscous border flow which is formed by the laminar flow of air. Such a damping prevents the air from becoming dispersed. Between the border lines B1 and B2, as shown in FIGS. 1 and 2, there is consequently formed a casing, that is a containment layer, or a shell, of nuclei. The second feature of the invention relates to the back zone, or the static eddy Z (see FIGS. 3, 5, 6) which is present just outside the outlet of the nose cone. The air velocity is practically zero at said static eddy, and the kinetic energy of the material leaving the atomizing nozzles is low. Therefore said material stays in the containment layer thereby building up super frozen ice crystals.

The necessary temperature for having the water freeze spontaneously, which is a temperature of −42° C., is obtained locally in the said static eddy by utilizing the specially shaped nose cone as a heat exchanger (pre-expansion) and the abrupt expansion when the material leaves the nozzle and is thereby subjected to atmospheric conditions.

In this way it has been possible to create nuclei and to provide a growth environment therefor, and to prevent the nuclei from co-acting with the bulk water during the entire length of the laminar aid flow. The bulk water has got sufficient time to become cooled to the temperature of the surrounding wet bulb before there is any mixing of water drops and nuclei.

The final stage of the method is the mixing of the fully grown up nuclei and the super cooled water drops. This is made by a turbulent, but still calm and steady mixing step which is made at the position III as shown in FIG. 2. The relationship of the pressure and the volume is changed in relation to the distance from the outlet of the nose cone and causes a breaking up of the border layer of the nuclei shells. The remaining kinetic energy provides a complete freezing of an optimum amount of the water particles while they are still presently suspended in the air, so that all water drops freeze to ice and solely ice crystals are spread and fall to the ground.

It has shown that it is of certain importance how the arrays of bulk water nozzles are arranged. The nozzles generally are mounted on several successive water supply rings. On the one hand the nozzles should not be mounted so as to obstruct the conveyor air provided by an air fan; on the other hand good effects are obtained if at least the nozzles of the first ring of nozzles, and eventually also the nozzles of two or more successive nozzles rings, open slightly inside the conveyor air flow. It is also of importance at what angles the bulk water jets are introduced. Very good effects have been obtained if the nozzles of the last ring of bulk water nozzles, as seen in the flow direction, are mounted so as to direct their water jets at a course angle to the axis of the conveyor air flow. By mounting said nozzles accordingly there is obtained an increased length and width of the static eddy at the mouth of the nose cone, and in addition thereto the flow or conveyor air can assist in providing a secondary splitting up of the water drops, both received from said last ring of bulk water nozzles, and to some extent also from the preceding rings of bulk water nozzles.

Now the invention is to be described more in detail with reference to the accompanying drawings.

In the drawings:

FIG. 1 very diagrammatically illustrates the method according to the invention.

Figure 1:
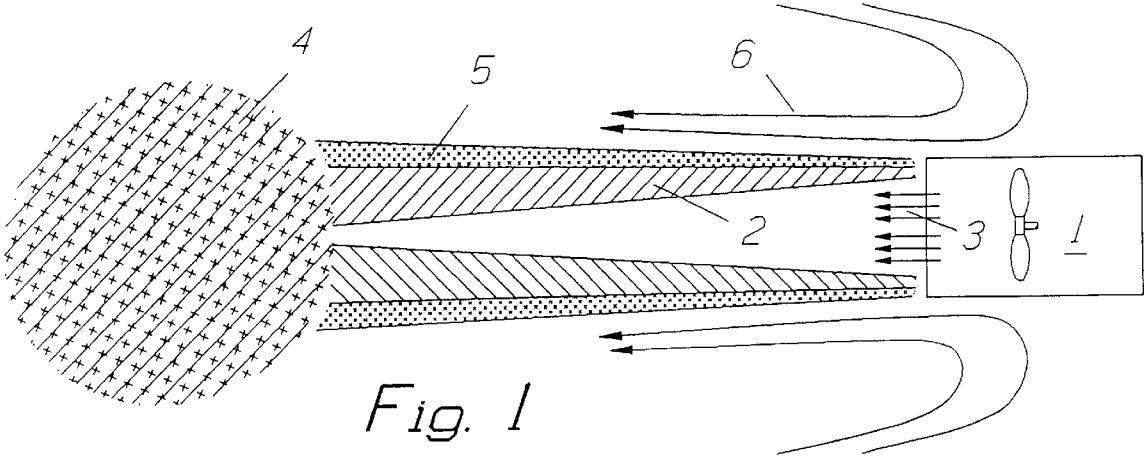

FIG. 1 shows a snow making machine 1 which is arranged, as known per se, to eject a tubular curtain or a bulk flow 2 of water drops which are moved along from the snow making machine by means of an air flow 3 which is laminarly adjacent the snow making machine 1 but which turns to a turbulent flow 4 some distance therefrom. According to the invention a shell 5 of nuclei is formed adjacent the outer periphery of the snow making machine, and more particularly at the back zone (static eddy) Z of the mouth or tip of the nose cone, which nuclei shell is conveyed by a flow 6 of ambient air which sweeps over and past the nose cone of the snow making machine. It is indicated in FIG. 1 that the bulk flow 2 of water drops and also the shell of nuclei widen conically from the snow making machine, whereby the water drops of the bulk flow 2, during the laminar part of the air flow 3, get a relatively long time for being cooled to the existing so called "wet bulb" temperature (the temperature of the circumferential cold wall B1, see FIGS. 2 and 3) and to become frozen to form ice crystals. A more complete contact between the nuclei and the water drops/ice crystals is obtained at the turbulent part 4 of the flow, in which all remaining water drops, or at least the major part of the still not frozen water drops, become finally frozen.

Figure 2:
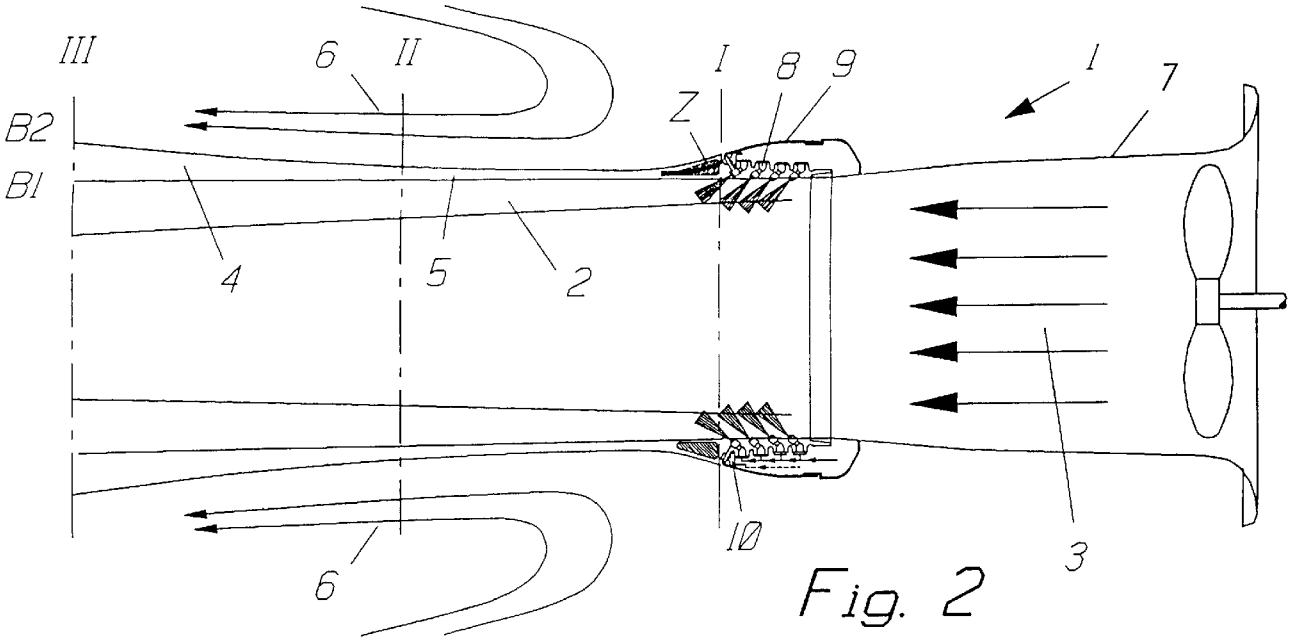
FIG. 2 illustrates more in detail the system stage comprising the creation of a shell of nuclei.

FIG. 2 shows a snow making machine according to invention having an air inlet funnel 7 in which an (not illustrated) air fan is mounted for creating the flow 3 of air which moves off the bulk water drops, and at a later stage moves off the ice crystals, and which spreads same over a certain ground area. The snow making machine is formed with a large number of bulk water jet nozzles 8 for providing the flow of water drops, and said water jet nozzles are distributed in arrays around a tubular nozzle carrier. The water jet nozzles 8 are mounted obliquely inwards/forwards close to the outlet of the snow making machine. At the front end of the snow making machine, and adjacent the tip of a specially shaped nose cone 9, there is a series of atomizing nozzles 10 which are mounted round the periphery of the snow making machine, and which are of a type providing an extremely fine atomizing of water, whereby such extremely fine atomized water drops spontaneously freeze to −42° C. when expanding downstream the atomizing nozzles 10 thereby forming the super cooled nuclei which are needed for the process. The atomizing nozzles 10 are mounted radially outside the bulk water nozzles 8 and a slight distance in front thereof, as seen in the flow direction, and as close to the mouth or tip of the nose cone 9 that the water drops are being ejected into the static eddy Z, which is formed at the downstream front end of the nose cone. It is important that the nose cone forms a cover which sealingly engages the periphery of the snow making machine so that no air can enter from behind and sweep past the atomizing nozzles 10. The injection of the finely atomized drops of water into the back zone (static eddy) Z is made at the phase position which in FIG. 2 is marked as the static limit I. From said limit I the nuclei are moved in a laminar flow as far as to a limit II in the form of a surrounding shell 5 of super cooled nuclei. At the limit II the nuclei enter a turbulent air flow of successively increased turbulency. In the area between the limits I and II the nuclei grow at the same time as the water drops of the bulk( water flow 2 are allowed to become successively cooled to the existing wet bulb temperature B1. In the area between limit II and limit III there is an increased contact between the nuclei at the surrounding shell 5, in particular from the inner circumferential limit surface B1, and the water drops of the water bulk 2. The shell of nuclei cools the water drops and, concurrently therewith, prevents the water drops from becoming warmed up depending on a contact with ambient air 6. During the entire, rather long, way of movement between the limits I and III the water drops have a possibility of freezing, thereby forming ice crystals, depending on the contact with the nuclei, and as a consequence of said long time contact an optimum large amount of the water drops freeze to ice crystals. After the limit III there is a complete turbulency whereby eventually existing non-frozen water drops freeze to form ice crystals so that the mass which finally falls to the ground is a practically water free mass comprising completely frozen ice crystals.

Figure 3:
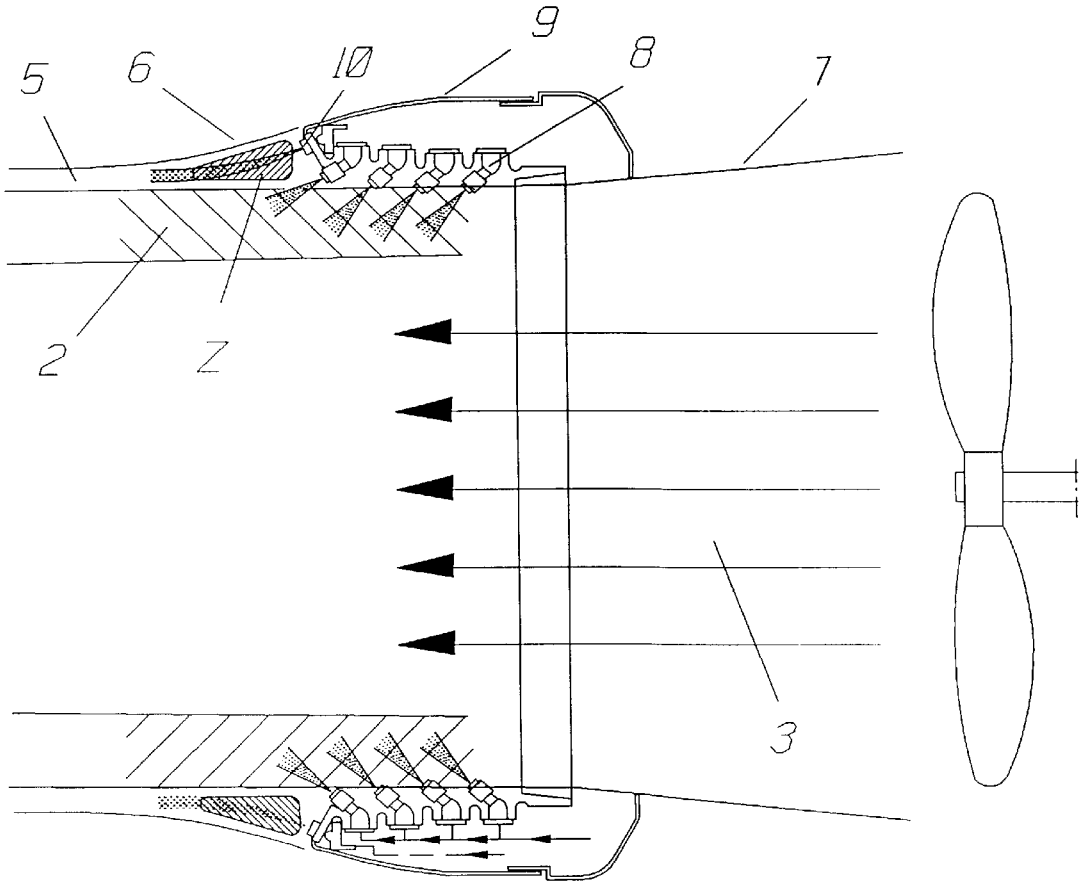
FIG. 3 shows a detail of FIG. 2 in a larger scale.
Figure 7:
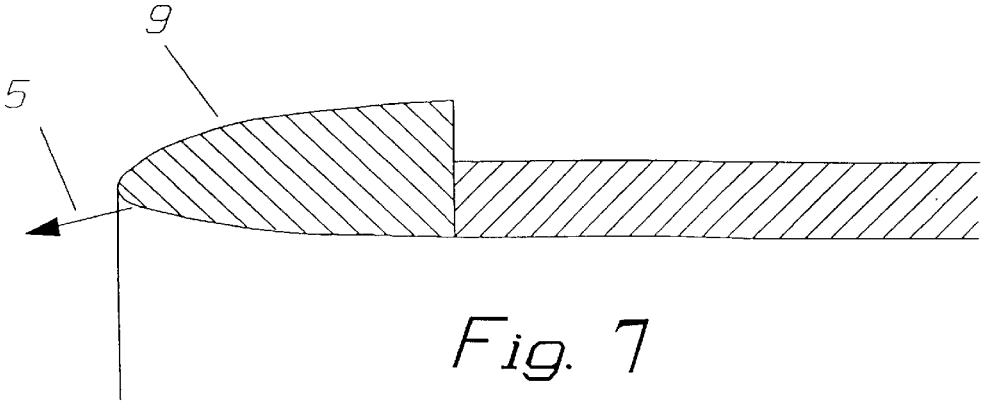
FIG. 7 shows the shape of the nose cone of a snow making machine according to the invention.

FIG. 3 shows more in detail how the water jet nozzles 8 are mounted inside the nose cone 9 and how the atomizing nozzles 10 are mounted and directed adjacent the tip of the nose cone 9. The nose cone has such a streamline shape, as best shown in FIG. 7, that there is created a static eddy Z at the outlet end thereof, in which zone Z the nuclei can be formed without any disturbing influence from the flow 2 of water drops or from the surrounding flow 6 of ambient air.

Figure 4:
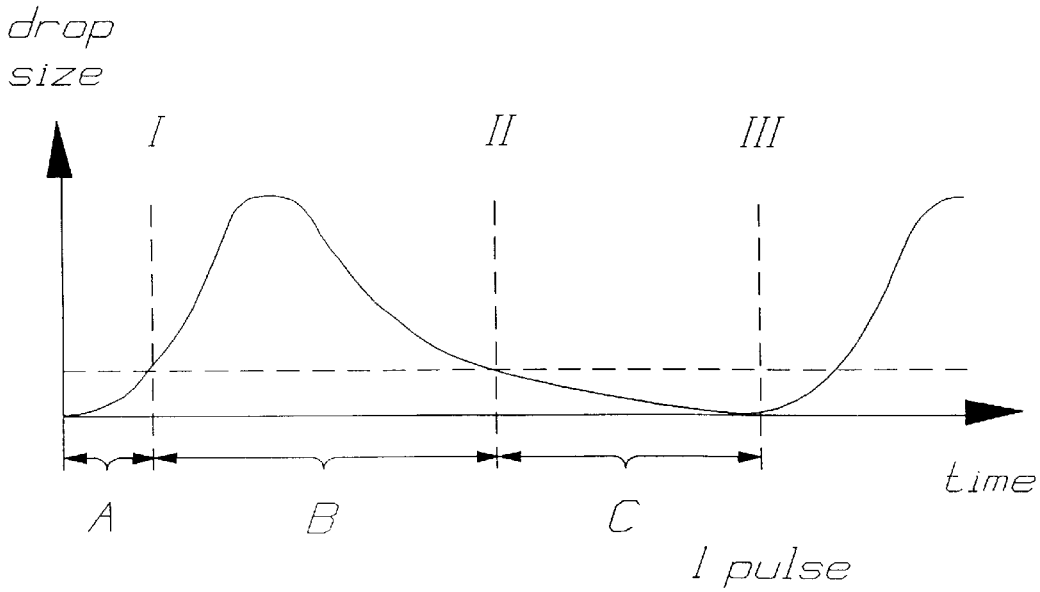
FIG. 4 illustrates the effect of the pulsing activity while creating the nuclei.

For creating nuclei as quickly as possible and at the best possible conditions it is advantageous to pulsate the flow of water through the atomizing nozzles 10. In FIG. 4 is illustrated how the nuclei are created and cool the bulk water in the above mentioned stages as far as to limits I, II and III during a cycle of pulsation, and the figure shows the changes in drop size in relation to the time, namely:

stage A, a short moment during which small super cooled ice crystals are created when the drops of water leave the atomizing nozzles;

stage B, in which the size of the ice crystals are built up without any change of environmental conditions;

stage C, during which aggregates of ice crystals and water drops are successively built up until the water drops are completely frozen to ice crystals.

Figure 5:
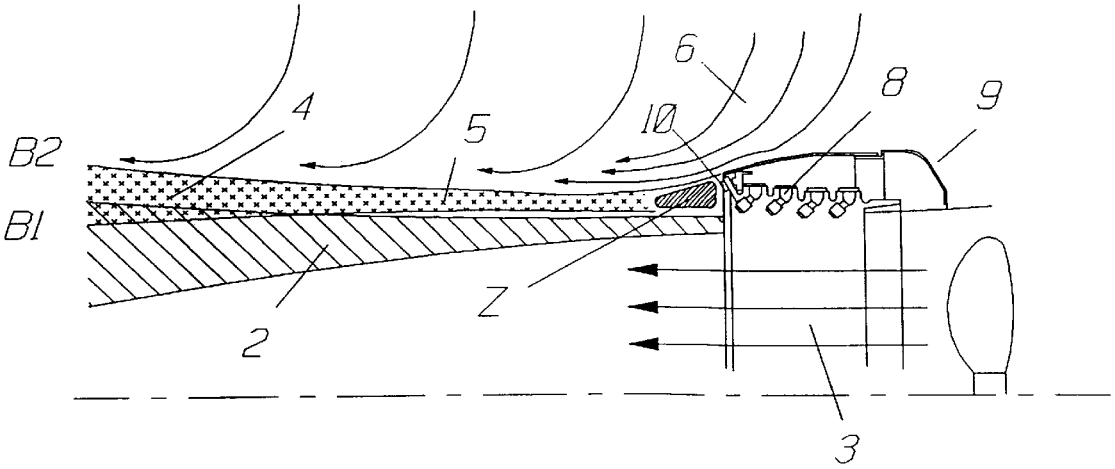
FIG. 5 shows the air flows in and around the snow making machine.
Figure 6:
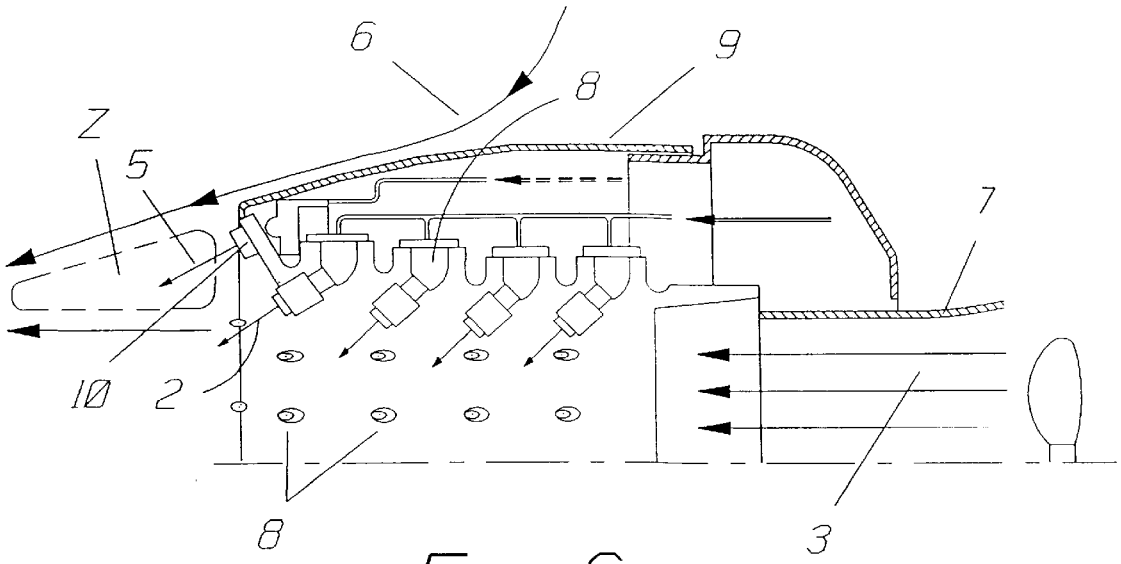
FIG. 6 is a cross section through a portion of the injection part of the snow making machine.

In FIGS. 5 and 6 is illustrated how the flow of bulk water drops 2 is moved along by the central air flow 3 of the snow making machine and how the flow of nuclei 5 is forwarded from the static eddy Z by the flow 6 of ambient air passing by, and how the drops of water successively come into contact with, and are mixed with the nuclei after having been moved along by a substantially laminar flow of conveying air 3, whereas the flow of nuclei 5 form an insulating shell round the flow 2 of water drops.

As indicated in FIG. 7 the nose cone 9 ought to have a mouth or tip which, in a longitudinal cross section, is formed almost like a parabola, and which creates a static eddy Z downstream said tip of the nose cone. In said static zone Z the air speed is almost zero, and the nuclei have sufficient time for being built up to a shell 5 of nuclei extending circumferentially round the flow 2 of bulk water drops, and which shell is delimited interiorly by the border line B1 and exteriorly by the border line B2 by the accompanying flow 6 of ambient air (as shown in the drawings).

As mentioned above improved effects can be obtained if the arrays of bulk water nozzles are arranged in special radial locations and are directed at specific angles in relation to the longitudinal direction of the snow making machine.

Figure 8:
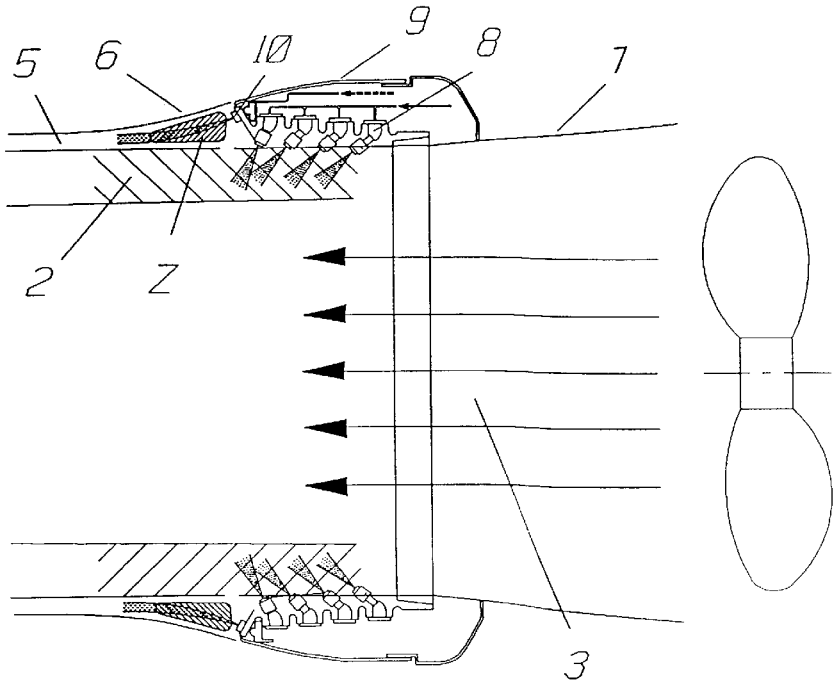
FIG. 8 shows a partial cross section view of a snow making machine having the bulk water nozzles mounted so as to give an improved effect.
Figure 9:
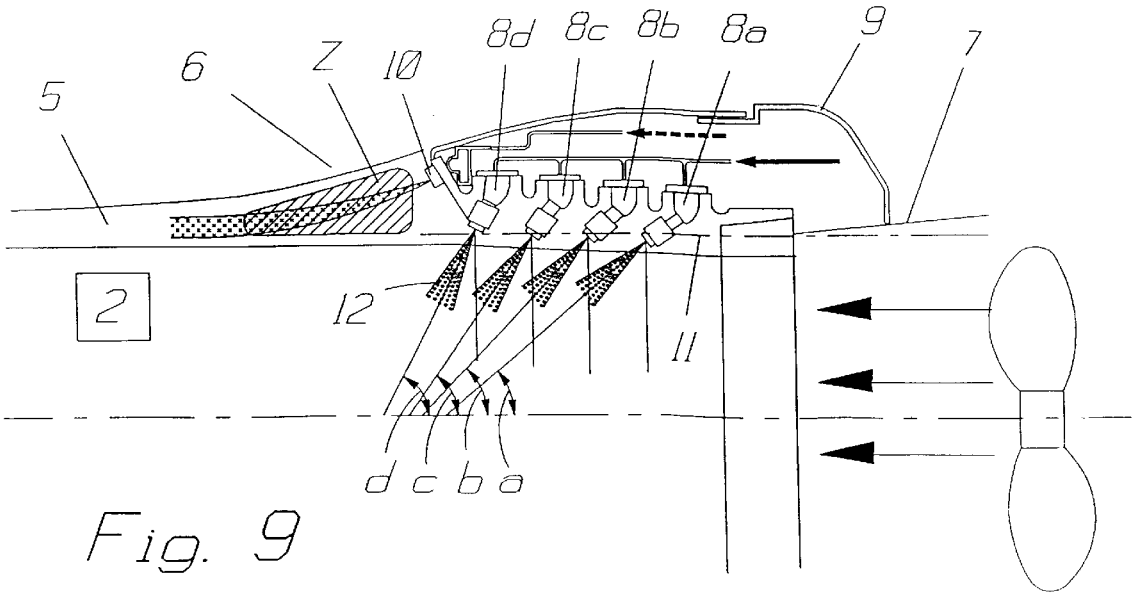
FIG. 9 is an explanatory view of, in an enlarged scale, of the bulk water nozzles of FIG. 8.

The nozzles generally are mounted on several successive water supply rings, 8*a*, 8*b*, 8*c* and 8*d* as shown in FIG. 9. On the one hand the nozzles should not be mounted so as to obstruct the conveyor air 3 provided by an air fan; on the other hand good effects are obtained if at least the nozzles of the first ring 8*a* of nozzles, and eventually also the nozzles of two or more successive nozzles rings 8*b*, 8*c* and 8*d*, open slightly inside the outer periphery 11 of the conveyor air flow. In FIGS. 8 and 9 is shown that the nozzles of the first ring 8*a* open radially inside the air flow 3, whereas the nozzles of the succeeding rings 8*b*, 8*c* and 8*d* open closed to, or even slightly outside said air flow periphery 11.

It is also of importance at what angles the bulk water jets are introduced. Very good effects have been obtained if the nozzles of the last ring of bulk water 8*d*, as seen in the flow direction, are mounted so as to direct their water jets 12 at a rather course angle d to the axis of the conveyor air flow 3. The angle may be e.g. 50°–75°, or preferably 60°–70°. By mounting said nozzles 8*d* accordingly there is obtained an increased length and width of the static eddy Z at the mouth of the nose cone 9, and in addition thereto the flow of conveyor air can assist in providing a secondary splitting up of the water drops therefrom.

Also the further nozzles 8*a*, 8*b* and 8*c* should be mounted at specific angles, the first nozzles 8*a* e.g. at 25°–35°, the second nozzles 8*b* at e.g. 30°–40°, the third nozzles 8*c* e.g. at 35°–45°, etc. Thereby the conveyor air flow can provide an additional splitting up of the water drops both received from said last ring of bulk water nozzles 8*d*, and to some extent also from the preceding rings of bulk water nozzles 8*a*, 8*b* and 8*c*.

Reference numerals z static eddy
B1 inner border for nuclei
B2 outer border for nuclei
I limit for static stage
II limit for laminar flow
III limit for fully turbulent flow
1 snow making machine
2 flow of bulk water drops
3 feeder air flow
4 turbulent flow of nuclei
5 shell of nuclei
6 flow of ambient air
7 air inlet funnel
8 water jet nozzles
9 nose cone
10 atomizing nozzles
11outer periphery of feeder air flow 3
12water jet

I claim:

1. Method for artificial making of snow by means of a snow making machine having an outer periphery (1) comprising a series of nozzles (8) arranged to provide a tubularly extending flow (2) of bulk water drops which are moved along by an inner flow (3) of feeder air, and a series of atomizing nozzles (10) arranged to provide a laminar flow of super cooled nuclei, said laminar flow having a surface wherein the flow of nuclei is created at or adjacent the outer periphery (9) of the snow making machine, without being influenced by the air flow (3) conveying the flow (2) of bulk water drops, by means of a series of atomizing nozzles (10) distributed round the snow making machine, whereby there is formed a shell (5) of super cooled nuclei extending circumferentially round the flow (2) of water drops, which successively, and over a relatively long way of movement provides a cooling down and freezing of the drops of water in the flow (2) of bulk water drops.

2. Method according to claim 1, wherein the freezing to ice of the water drops in the flow (2) of bulk water drops is made in two stages, a first stage (I-II), in which the flow (2) of bulk water drops is brought into contact with the surface (B1) of a said substantially laminary flow of super cooled nuclei, and a second stage (II-III) in which the water drops are mixed with a turbulent flow of the super cooled nuclei.

3. Method according to claim 1 or 2 wherein the atomizing nozzles are mounted radially outside the bulk water jet nozzles and wherein the snow making machine includes a nose cone having a tip formed as a sealed cover designed so as to provide a static eddy zone (Z) at the downstream end of the nose cone tip, in which zone Z the flow speed is almost zero, and into which zone said atomized water drops from said atomizing nozzles (1) are injected and in which the atomized water drops can be super cooled without being influenced by the ambient flows of air (6) or water drops (2).

4. Method according to claim 1, wherein the flow of water through the atomizing nozzles (10) is pulsated, whereby the super cooled nuclei, thereby formed, get a possibility of building themselves up to an increased volume before the cooling capacity of the nuclei is fully utilized for freezing the water drops of the flow (2) of bulk water drops.

5. Method according to claim 1, wherein the nose cone (9) of the snow making machine (1) is a sealed cover and is formed so as to direct a pliable flow (6) of ambient air past the nose cone (9) and so that said ambient air flow moves the nuclei out from the snow making machine in the form of a shell (5) of nuclei, first having a laminary flow over a certain length, whereby the water drops of the flow (2) of bulk water drops get a relatively long time for being cooled down and frozen, and thereafter, in a successively increased turbulent flow (4), the bulk water drops are being freezed completely.

6. Apparatus for making snow comprising a snow making machine (1) having a periphery comprising a series of bulk water jet nozzles (8) arranged so as to provide a conveyor air flow (3) for moving said flow (2) of bulk water drops forwardly, and a series of atomizing nozzles (10) arranged to provide a flow (5) of super cooled nuclei, wherein the atomizing nozzles (10) are distributed over a ring extending round the snow making machine at or close to the periphery thereof and radially outside the series of bulk water nozzles (8).

7. Apparatus according to claim 6, wherein the snow making machine is formed with a nose cone (9) having a streamline shape and formed as a cover which sealingly engages the periphery of the snow making machine, and in that the atomizing nozzles (10) are mounted at or adjacent the tip of the nose cone (9) and downstream the bulk water jet nozzles (8).

8. Apparatus according to claim 7, wherein the nose cone (9) is designed so that the downstream end thereof provides a static eddy (Z) which is not influenced by the feeder air flow (3) for the bulk water drops (2), and in which the flow speed is almost zero, into which zone (Z) the flow (5) of atomized (10) water drops is injected, and in which said atomized water drops are allowed to become super cooled thereby creating nuclei, and from which zone (Z) said nuclei are forwarded by a flow (6) of ambient air in the form of a circumferentially extending shell (5) of super cooled nuclei in a flow which is first a laminary flow (I-II) and is thereafter turned to a flow (II-III) of successively increased turbulency.

9. Apparatus according to claim 6, wherein the apparatus comprises first means for ejecting a continuous flow of water drops through the bulk water jet nozzles (8), and further means for ejecting a pulsating flow of water atomized water drops through the atomizing nozzles (10).

10. Apparatus according to claim 9, wherein the bulk water jet nozzles (8*a*–8*d*) are mounted in successive radial arrays, in that the nozzles (8*d*) of the last array of water jet nozzles, as seen in the flow direction, are mounted at angles of 50°–750°, and in that the nozzles (8*a*–8*c*) of the preceding arrays of bulk water jet nozzles are mounted at angles of 25°–45° to the flow direction, eventually at successively increased angles for the successive arrays of nozzles (FIGS. 8 and 9).

* * * * *